US005339863A

United States Patent [19]

Van Wie

[11] Patent Number: 5,339,863

[45] Date of Patent: Aug. 23, 1994

[54] PORT MOUNTED IMPLEMENT SELECTOR

[75] Inventor: David Van Wie, Prior Lake, Minn.

[73] Assignee: Mid-America Power Drives Manufacturing & Distributing, Inc., Burnsville, Minn.

[21] Appl. No.: 992,599

[22] Filed: Dec. 18, 1992

[51] Int. Cl.[5] ..... F15B 13/06

[52] U.S. Cl. ..... 137/798; 137/884; 285/178

[58] Field of Search ..... 137/798, 884; 285/178

[56] References Cited

U.S. PATENT DOCUMENTS

| | | |
|---|---|---|
| 1,725,987 | 8/1929 | Kersten . |
| 3,337,181 | 8/1967 | Wennerstrom . |
| 3,512,453 | 5/1970 | Balzer . |
| 3,556,147 | 1/1971 | Sizer et al. . |
| 3,985,394 | 10/1976 | Rolfes . |
| 4,047,587 | 9/1977 | Anstey . |
| 4,116,476 | 9/1978 | Porter et al. . |
| 4,816,083 | 3/1989 | Bangyan . |
| 4,949,757 | 8/1990 | Lashta . |

FOREIGN PATENT DOCUMENTS 1123345 8/1968 United Kingdom .

OTHER PUBLICATIONS

Product brochure by May Wes TM, "Do You Ever Need More Than One Power Source? Are You Tired of Swapping Hoses?", Feb. 1992.

Advertisement from FBS Corporation, "The Remote Master Does It All!!!", Nov. 1991.

1992 Agri-Products Price Book, May Wes TM, cover page, back page, and p. 60, Jan. 1992.

*Primary Examiner*—Gerald A. Michalsky

*Attorney, Agent, or Firm*—Merchant, Gould, Smith, Edell, Welter & Schmidt

[57] ABSTRACT

A port mounted implement selector that may be directly connected to an existing hydraulic system having outlet ports. A valve unit is used to control the flow of hydraulic fluid between a single inlet and multiple outlets as selected by an operator. The valve unit is coupled to the hydraulic system outlet ports with a pair of rotatable bolts each having an off-center inlet port. The bolts may be rotated about their longitudinal axis to adjust the lateral positions of the adjacent inlet ports to facilitate the direct connection of the implement selector to a variety of hydraulic system outlets having varying distances between the two outlet ports.

10 Claims, 4 Drawing Sheets

PORT MOUNTED IMPLEMENT SELECTOR

FIELD OF THE INVENTION

The present invention pertains generally to hydraulic power systems, and more particularly to the conversion of a single outlet hydraulic power system to a multiple outlet system.

BACKGROUND OF THE INVENTION

Older machines such as farm tractors are typically equipped with a single pair of hydraulic system outlet ports that allow an operator to attach and operate hydraulically driven implements for use with the machine or tractor. As is well known in the art, it is possible to convert a single pair of outlet ports into multiple pairs of outlet ports by using an externally attached valve.

However, attaching the valve to the hydraulic system remains a problem. A first approach is to use standard fittings and hoses to connect the hydraulic system outlets to the valve inlets. While this is functional, it requires a protected location on the machine or tractor where the valve can be securely mounted and the hydraulic hoses connected in a safe manner without interfering with the operation of the machine. Such a location may not always be available or convenient.

A second approach is to directly mount the valve inlet ports to the hydraulic system outlet ports. However, the lateral distance between the hydraulic system outlet ports varies between equipment manufacturers and also varies due to manufacturing tolerances. Therefore, an adjustable direct mounting is required in order to accommodate the varying distances between the outlet ports. One solution to the problem of varying outlet port distances involves the use of extended valve inlet fittings containing two 90° bends which may be rotated to adjust the relative distance between the inlet port fittings to match that of the outlet ports. However, it is difficult and unwieldy for an operator to adjust such extended fittings. In addition, the length of the extended fittings causes mechanical stress to be placed on the fittings and hydraulic system outlets due to the weight of the valve unit and attached hoses. The direct mount is not strong or stable and typically the valve must therefore be supported by additional means. Supporting the valve suffers from the same drawbacks as that of the first approach described above.

Therefore, there is a need for a strong, stable, easy-to-use way of directly converting a single outlet hydraulic power system to a multiple outlet system to enable the use of multiple implements.

SUMMARY OF THE INVENTION

The present invention provides for a port mounted implement selector that may be directly connected to an existing hydraulic system having outlet ports. A valve unit is used to control the flow of hydraulic fluid between a single inlet and multiple outlets as selected by an operator. The valve unit is coupled to the hydraulic system outlet ports with a pair of rotatable bolts each having an off-center inlet port. The bolts may be rotated about their longitudinal axis to adjust the lateral positions of the adjacent inlet ports to facilitate the direct connection of the implement selector to a variety of hydraulic system outlets having varying distances between the two outlet ports.

DETAILED DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
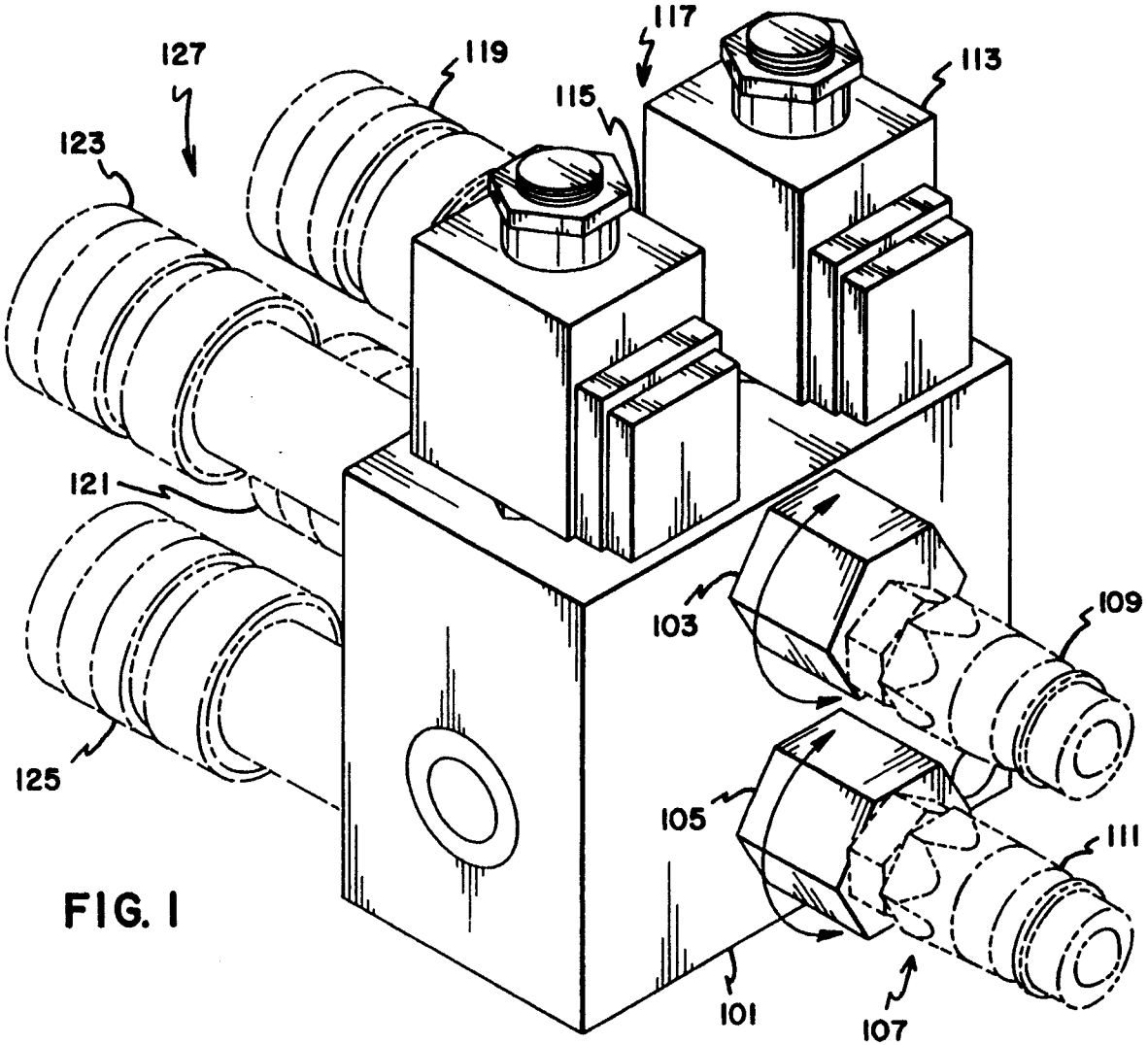
FIG. 1 is a top right-perspective view of a port mounted implement selector compatible with the present invention.

FIG. 1 shows a typical direct mount implement selector having a valve housing 101, multiple valve actuators 117 including solenoid actuators 113 and 115, and multiple valve outlets 127 including well-known female quick disconnect couplings 119, 121, 123, 125 as outlet port fittings. Multiple valve inlet port fittings 107, including well-known male quick disconnect couplings 109 and 111 as inlet port fittings, are connected to rotatable bolt heads 103 and 105. It will be recognized that the male quick disconnect couplings 109, 111, and female quick disconnect couplings 119, 121, 123, 125 may be replaced by other types of couplings and fittings without loss of generality. The rotatable bolt heads 103, 105 may be easily rotated by hand in either direction about the longitudinal axis of the bolt heads 103, 105 to adjust the lateral spacing of the inlet port fittings 109, 111 to be subsequently connected to a variety of hydraulic system outlets having varying distances between the two hydraulic system outlet ports.

Figure 2:
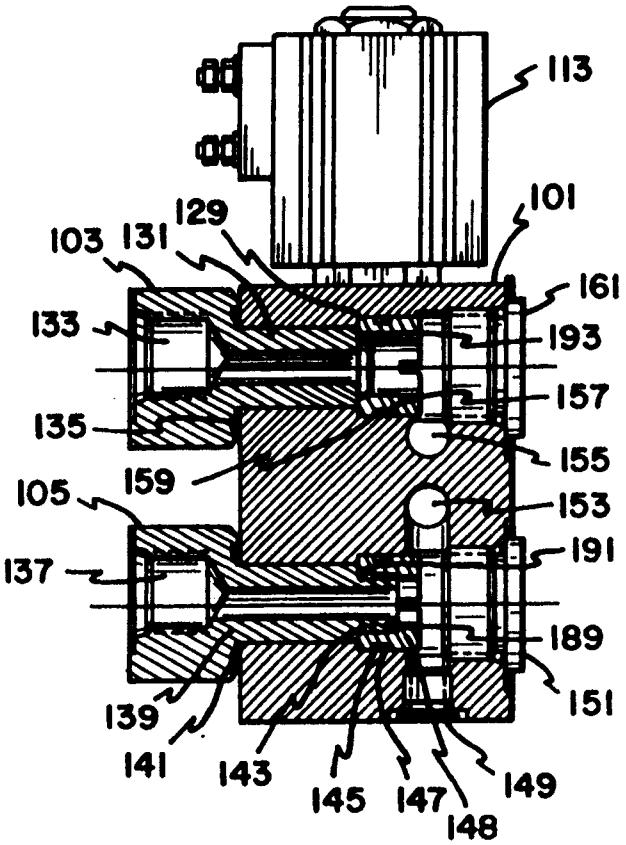
FIG. 2 is a cut-away left plan view of a port mounted implement selector compatible with the present invention.

FIG. 2 shows a cut-away view of the preferred embodiment of the implement selector. Rotatable bolt heads 103, 105 having off-center inlet ports 133, 137, typically form an exterior portion of bolts 131, 139. The bolt heads 103, 105 and bolts 131, 139 are free to rotate in either direction about the longitudinal axis of the bolts 131, 139. As the inlet port centers 175, 181 of the off-center inlet ports 133, 137 are offset from the bolt centers 177, 183 of the longitudinal axis of the bolt heads 103, 105, when bolt heads 103 and 105 are rotated, the lateral distance between the off-center inlet ports 103, 105 may be increased or decreased anywhere from zero to a maximum of the sum of the offset distances 185, 187, for a total range of twice the sum of the offset distances 185, 187, depending on the amount of the rotation. For example, if the offset distance 185 is 0.25 inches and the offset distance 187 is 0.25 inches, the relative distance between inlet ports 103, 105 may be increased by 0.50 inches or decreased by 0.50 inches, for a total range of 1.0 inch. Increasing or decreasing the lateral distance between the off-center inlet ports 103, 105 allows the implement selector to be fitted to a variety of hydraulic system outlets having varying distances between the two hydraulic system outlet ports. The off-center inlet ports 103, 105 are typically threaded to allow the connection of inlet port fittings 109, 111.

Bolts 131, 139 are situated firmly within the body of the valve housing 101, although it will be recognized that the bolts 131, 139 may instead be replaced by sleeve mounts on the exterior of the valve housing 101 without loss of generality. Because a substantial portion of bolts 131, 139 are located within the valve housing 101, they provide a strong, stable mechanical support for the implement selector connection to a hydraulic system. The bolt heads 103, 105 typically form an integral part of the bolts 131, 139, although it will be recognized that bolt heads 103, 105 may be replaced by separately rotatable sleeves on the bolts 131, 139, or alternately separately rotatable sleeves on external sleeve mounts, without loss of generality. Bolt retainers 129, 148 are screwed onto the threaded portion 189 of the shank of the bolts 131, 139 in order to retain the bolts 131, 139 within the valve housing 101. The threaded portion of the shank of bolt 131 is obscured in the drawing by bolt retainer 129. The retainers 129, 148 are prevented from clamping the bolts 131, 139 into the valve housing due to the shoulders 191, 193 on the shank of bolts 131, 139. As the bolts 131, 139 rotate, the corresponding bolt retainers 129, 148 also rotate.

Hydraulic fluid such as oil is circulated to the valves through the inlet ports 133, 137, bolt heads 103, 105 and bolts 131, 139 through the valve inlet channels 153, 155. Plugs 149, 151, 161, 0-ring seal 143, and 0-ring seals 147, 157 in conjunction with backup washers 145, 159 prevent the loss of oil from the system. 0-ring seals 135, 141 are used to keep dust out of the system.

Figure 3:
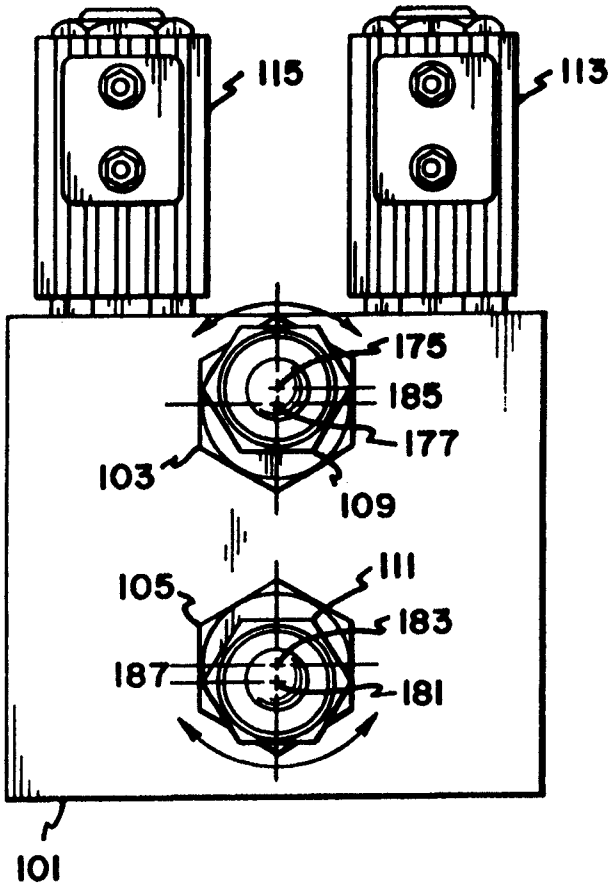
FIG. 3 is a front plan view of a port mounted implement selector compatible with the present invention.
Figure 5:
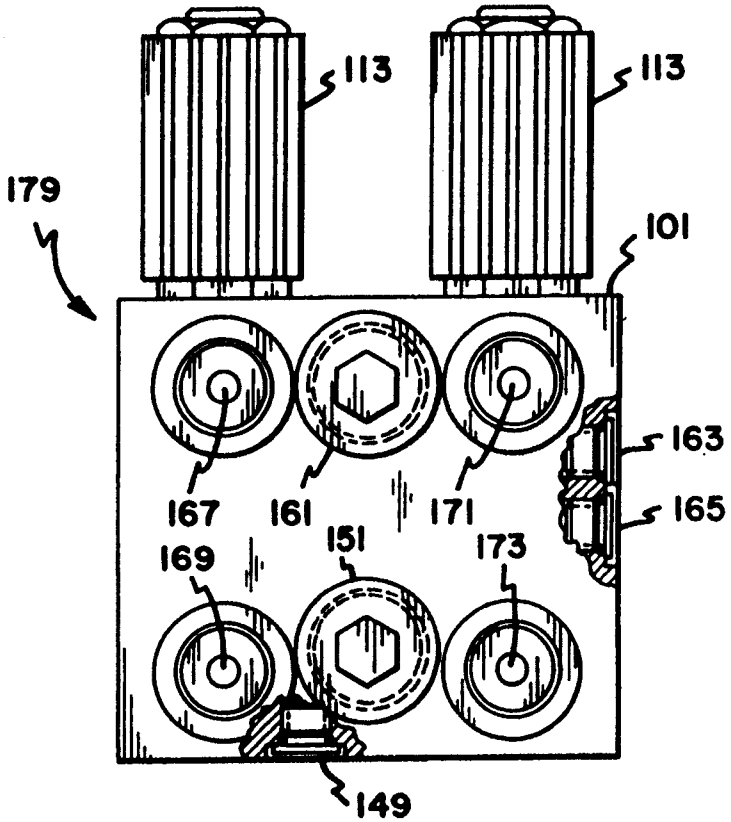
FIG. 5 is a cut-away rear plan view of a port mounted implement selector compatible with the present invention.
Figure 4:
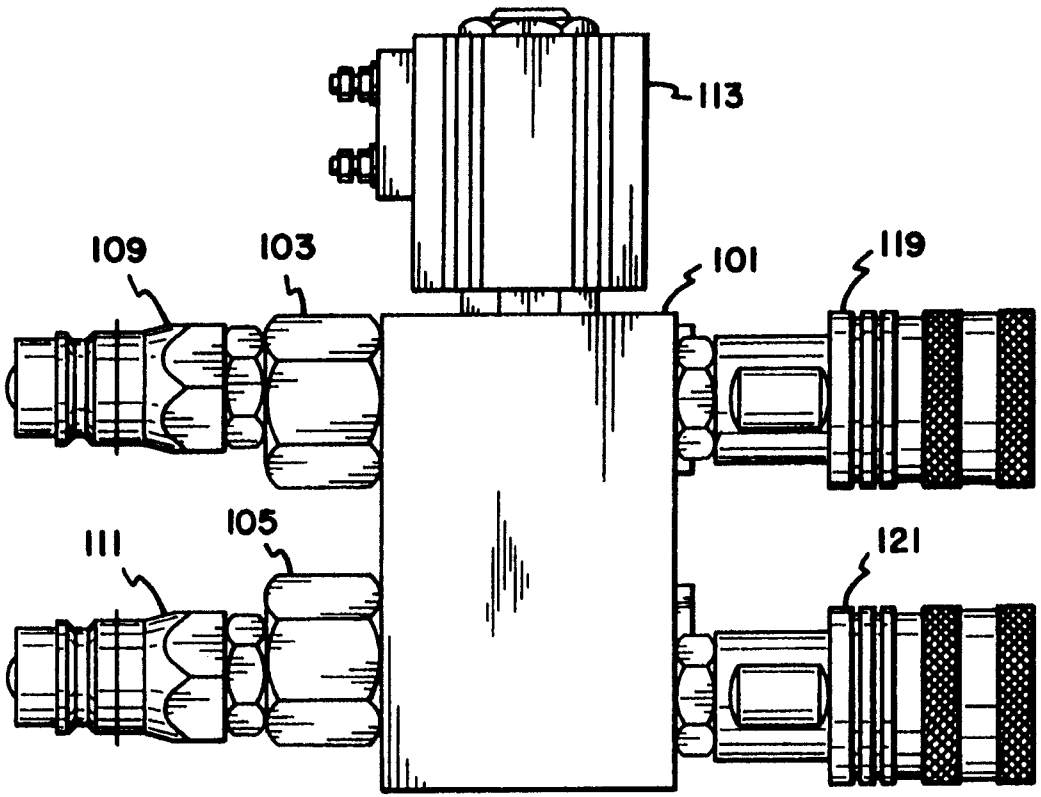
FIG. 4 is a left plan view of a port mounted implement selector compatible with the present invention.

FIGS. 3 and 4 show external views of the preferred embodiment of the implement selector. FIG. 5 shows the rear view of the preferred embodiment of the implement selector having multiple pairs of valve outlets 179, including outlet ports 167, 169, 171, 173. Plugs 163, 165 prevent the loss of oil from the system.

Figure 6:
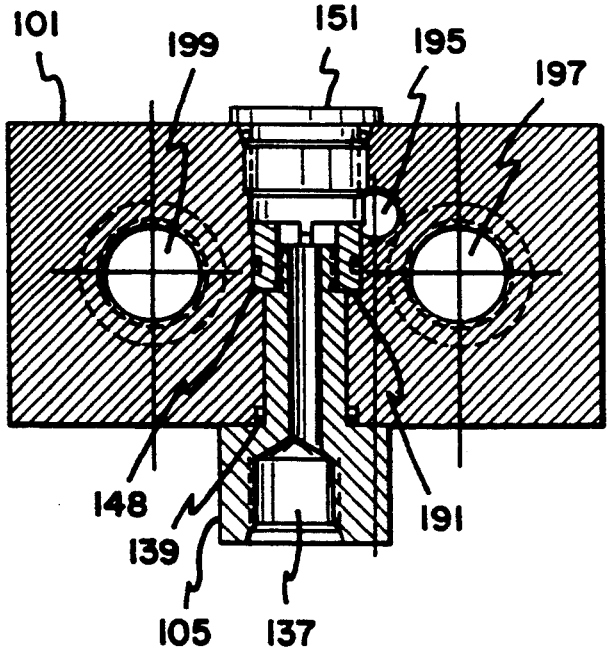
FIG. 6 is a cut-away top plan view of a port mounted implement selector compatible with the present invention.

FIG. 6 shows a top view of the preferred embodiment of the implement selector. Vertical channel 195 is used to allow oil to flow through to inlet channel 153 from inlet port 137. Cavities 197 and 199 are used to valve connect the inlet ports 133, 137 with outlet ports 167, 169, 171, 173. A third-party valve cartridge such as a Parker Fluid Power "Solenoid Cartridge Valve", Part No. DS 10 4 E1 D012 is inserted into channels 197 and 199 in order to provide the valves for the implement selector. It will be recognized that other types of valves and valve cartridges may be used in place of the Parker Fluid Power valve cartridge without loss of generality. Each of the valves may be selectively positioned into open and closed positions by the solenoid actuators 113, 115 upon receipt of an appropriate electrical control or other equivalent signal from an operator.

The use of well-known quick disconnect female couplings 119, 121, 123, 125 as outlet port fittings and male quick disconnect couplings 109, 111 as inlet port fittings allows the implement selector to be easily connected and disconnected to a hydraulic system and hydraulic implements.

The present invention is to be limited only in accordance with the scope of the appended claims, since others skilled in the art may devise other embodiments still within the limits of the claims.

What is claimed is:

1. An implement selector apparatus for converting a single outlet hydraulic system to a multiple outlet hydraulic system, the apparatus comprising:

(a) a valve housing comprising a plurality of valves, each of the plurality of valves being activated by its own valve actuator, each of the plurality of valves comprising a valve outlet having two outlet ports, the valve housing comprising a valve inlet having two inlet ports coupled to the plurality of valves; and (b) external connection means for connecting the valve inlet to the single outlet hydraulic system, the connection means having at least one rotatable member substantially contained within the valve housing, the at least one rotatable member having an off-center inlet port, wherein the at least one rotatable member may be freely rotated about the longitudinal axis of the at least one rotatable member while maintaining a constant axial displacement from the valve housing to adjust the lateral position of the two inlet ports.

2. The implement selector apparatus of claim 1 wherein the valve inlet comprises at least one pair of inlet ports for supply and return flow.

3. The implement selector apparatus of claim 1 wherein each of the plurality of valve outlets comprise at least one pair of outlet ports for supply and return flow.

4. The implement selector apparatus of claim 1 wherein each of the plurality of valve actuators comprise a solenoid actuator.

5. The implement selector apparatus of claim 1 wherein each of the rotatable members comprises a bolt at least partially contained within the valve housing.

6. An implement selector apparatus for converting a single outlet hydraulic system to a multiple outlet hydraulic system, the single outlet hydraulic system having two outlet ports and means for supplying hydraulic fluid under pressure to the single outlet hydraulic system, the apparatus comprising:

(a) a valve housing comprising a plurality of valves, each of the plurality of valves comprising a valve outlet having two outlet ports, the valve housing comprising a valve inlet having two inlet ports coupled to the plurality of valves;

(b) a plurality of actuator means coupled to the each of the plurality of valves for selectively activating each of the plurality of valves into a valve open and closed position, each of the plurality of actuator means being independent of each other; and (c) external connection means for connecting the valve inlet to the single outlet hydraulic system, the connection means having at least two rotatable members substantially contained within the valve housing, each of the rotatable members having an off-center inlet port, wherein each of the rotatable members may be freely rotated about the longitudinal axis of each of the rotatable members while maintaining a constant axial displacement from the valve housing to adjust the lateral position of the adjacent inlet port to facilitate the direct connection of the implement selector apparatus to a variety of hydraulic system outlets having varying distances between the two hydraulic system outlet ports.

7. The implement selector apparatus of claim 6 wherein the valve inlet comprises at least one pair of inlet ports for supply and return flow.

8. The implement selector apparatus of claim 6 wherein each of the plurality of valve outlets comprise at least one pair of outlet ports for supply and return flow.

9. The implement selector apparatus of claim 6 wherein each of the plurality of valve actuator means comprise a solenoid actuator.

10. The implement selector apparatus of claim 6 wherein each of the rotatable members comprises a bolt at least partially contained within the valve housing.

* * * * *

UNITED STATES PATENT AND TRADEMARK OFFICE
CERTIFICATE OF CORRECTION

PATENT NO. : 5,339,863

DATED : August 23, 1994

INVENTOR(S) : Van Wie

It is certified that error appears in the above-identified patent and that said Letters Patent is hereby corrected as shown below:

Column 3, line 50; delete "channels" and insert --cavaties--.

Signed and Sealed this

Fifth Day of September, 1995

*Attest:*

*Attesting Officer*

Bruce Lehman

BRUCE LEHMAN

*Commissioner of Patents and Trademarks*